US008007305B2

(12) United States Patent
Chen

(10) Patent No.: US 8,007,305 B2
(45) Date of Patent: Aug. 30, 2011

(54) ELECTRICAL CONNECTOR WITH LATCH

(75) Inventor: De-Jin Chen, Shenzhen (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/779,973

(22) Filed: May 14, 2010

(65) Prior Publication Data

US 2010/0291788 A1 Nov. 18, 2010

(30) Foreign Application Priority Data

May 14, 2009 (CN) ..... 2009 2 0303143

(51) Int. Cl.
*H01R 13/627* (2006.01)

(52) U.S. Cl. ..... 439/357

(58) Field of Classification Search ..... 439/357, 439/353, 358, 953
See application file for complete search history.

(56) References Cited

U.S. PATENT DOCUMENTS

| | | | | | |
|---|---|---|---|---|---|
| 5,538,437 | A * | 7/1996 | Bates et al. | ..... | 439/352 |
| 5,683,264 | A * | 11/1997 | Hobgood et al. | ..... | 439/352 |
| 5,820,254 | A * | 10/1998 | Duenas | ..... | 362/473 |
| 6,146,180 | A * | 11/2000 | Betker et al. | ..... | 439/352 |
| 6,149,450 | A * | 11/2000 | Gastineau | ..... | 439/325 |
| 6,241,558 | B1 * | 6/2001 | Mosquera | ..... | 439/660 |
| 6,743,053 | B2 * | 6/2004 | Wu | ..... | 439/634 |

* cited by examiner

*Primary Examiner* — Phuong K Dinh
(74) *Attorney, Agent, or Firm* — Wei Te Chung; Andrew C. Cheng; Ming Chieh Chang

(57) ABSTRACT

An electrical connector includes an elongated insulative housing and a plurality of terminals retained in the housing. The housing defines a mating face, a rear wall opposite to the mating face, two slots opening to the mating face and arranged side by side. A plurality of terminals are secured in the insulative housing. Each terminal defines a contact portion exposing to the corresponding slot. A latch integrally extends from the rear wall forwardly and is located between the two slots, the latch has two arms separated by a groove thereby providing resiliency.

3 Claims, 7 Drawing Sheets

ELECTRICAL CONNECTOR WITH LATCH

BACKGROUND OF THE INVENTION

1. Field of the Invention

The present invention relates to an electrical connector, and more particularly to a connector with a latch for stably mating with a mating connector.

2. Description of Related Arts

A conventional Serial ATA connector comprises an elongated insulative housing and a plurality of terminals secured in the housing. The housing defines a pair of elongated receiving slots along a horizontal direction. The two receiving slots are separated by a partition. A corresponding mating connector comprises a pair of mating tongues and a plurality of terminals exposed on the tongues. When the two connectors mate with each other, the two tongues are inserted into the corresponding receiving slots and the partition is located between the two tongues. Under working condition the two connectors sometimes maybe disengage from each other.

Hence, a new electrical connector is desired.

SUMMARY OF THE INVENTION

Accordingly, an object of the present invention is to provide a electrical connector which mates with a mating connector firmly.

To achieve said object, an electrical connector comprises an elongated insulative housing and a plurality of terminals retained in the housing. The housing defines a mating face, a rear wall opposite to the mating face, two slots opening to the mating face and arranged side by side. A plurality of terminals are secured in the insulative housing. Each terminal defines a contact portion exposed to the corresponding slot. A latch integrally extends from the rear wall forwardly and is located between two slots, the latch has two arms separated by a groove thereby providing resiliency.

Other advantages and novel features of the invention will become more apparent from the following detailed description of the present embodiment when taken in conjunction with the accompanying drawings

DETAILED DESCRIPTION OF THE PREFERRED EMBODIMENT

Further detailed description of the preferred embodiments of this present invention is set forth below along with the attached drawings.

Figure 1:
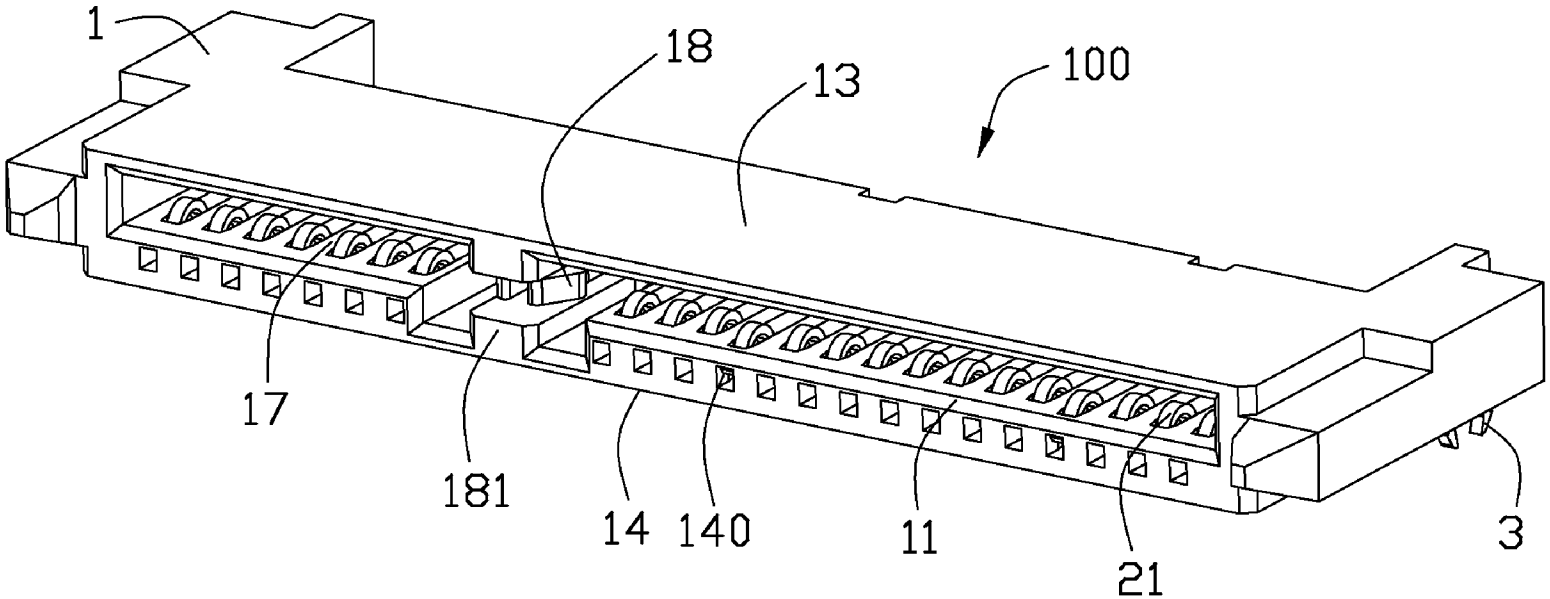
FIG. 1 is a perspective view of a first electrical connector of a preferred embodiment in accordance with the present invention.
Figure 2:
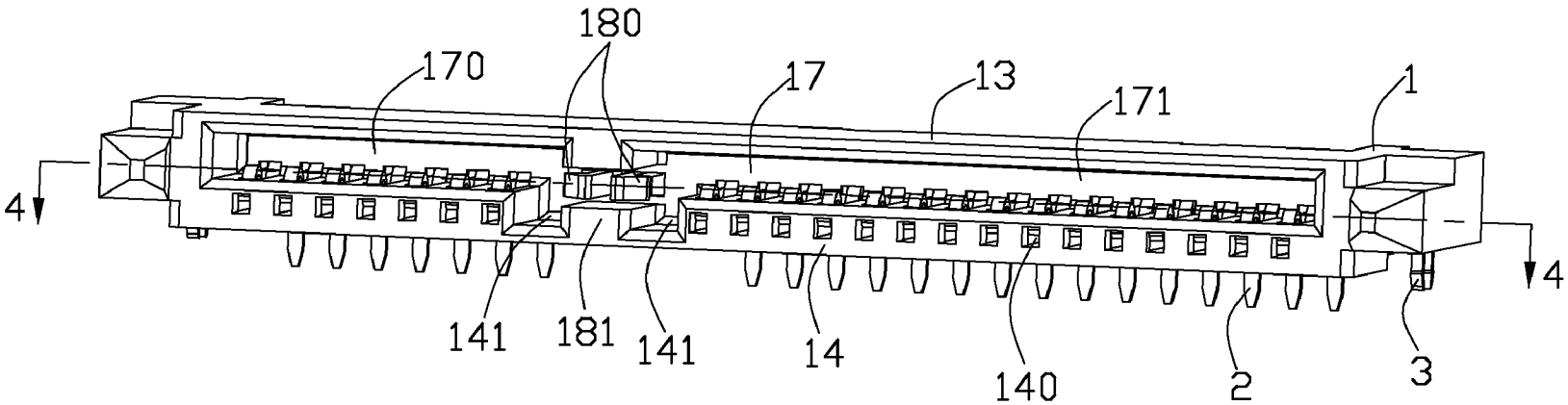
FIG. 2 is an another perspective view of the first the electrical connector of FIG. 1, viewed from another aspect.
Figure 3:
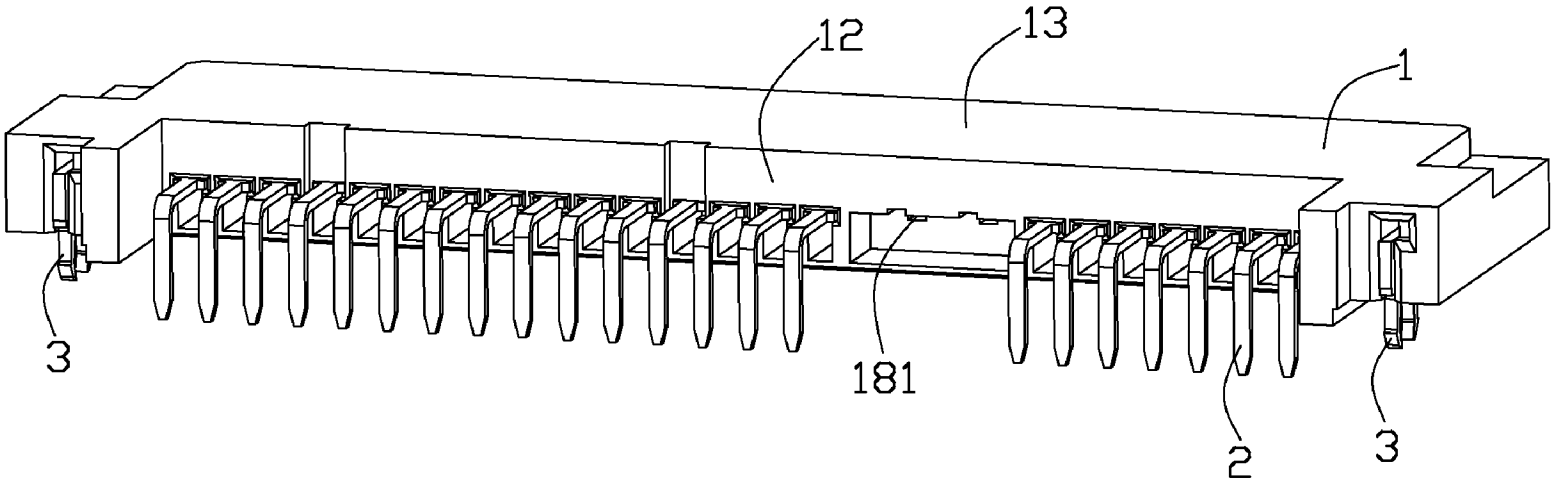
FIG. 3 is an another perspective view of the first the electrical connector of FIG. 1, viewed from back aspect.
Figure 4:
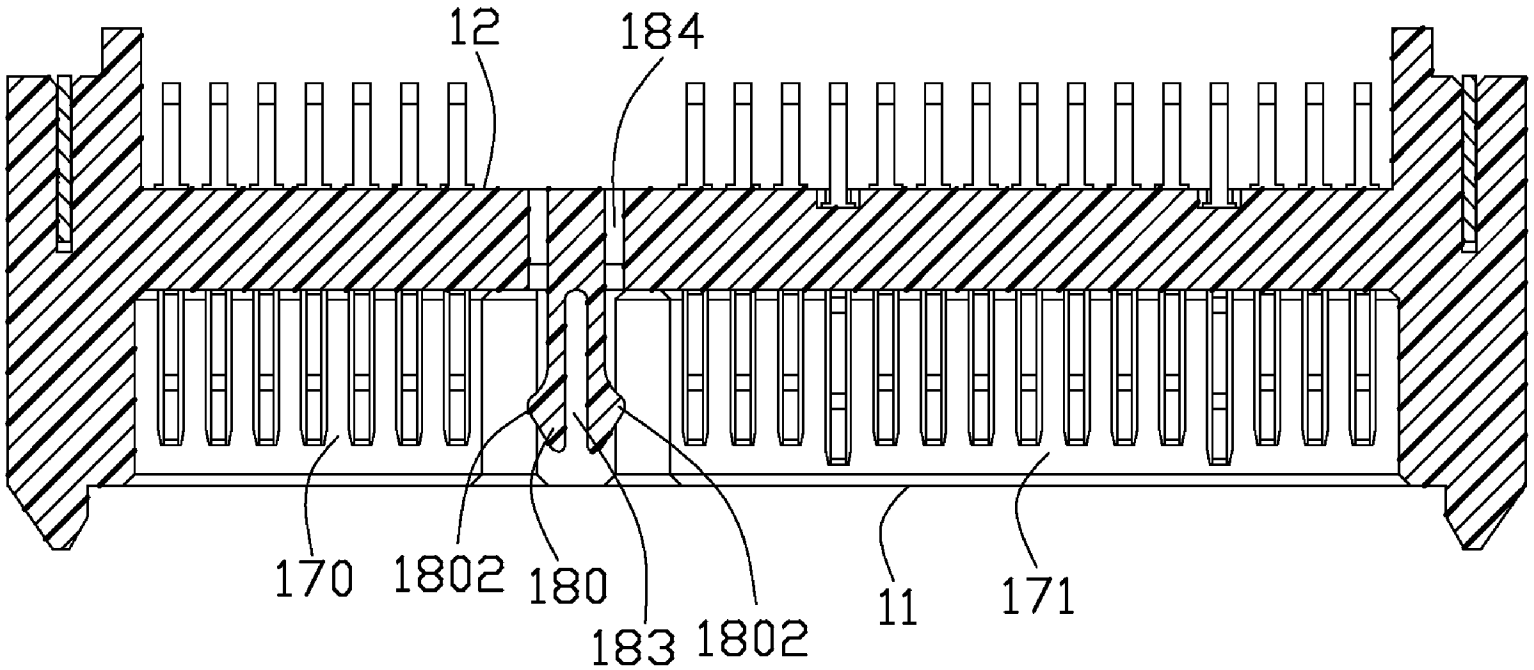
FIG. 4 is a cross sectional view of the first electrical connector, taken along line 4-4 of FIG. 2.
Figure 5:
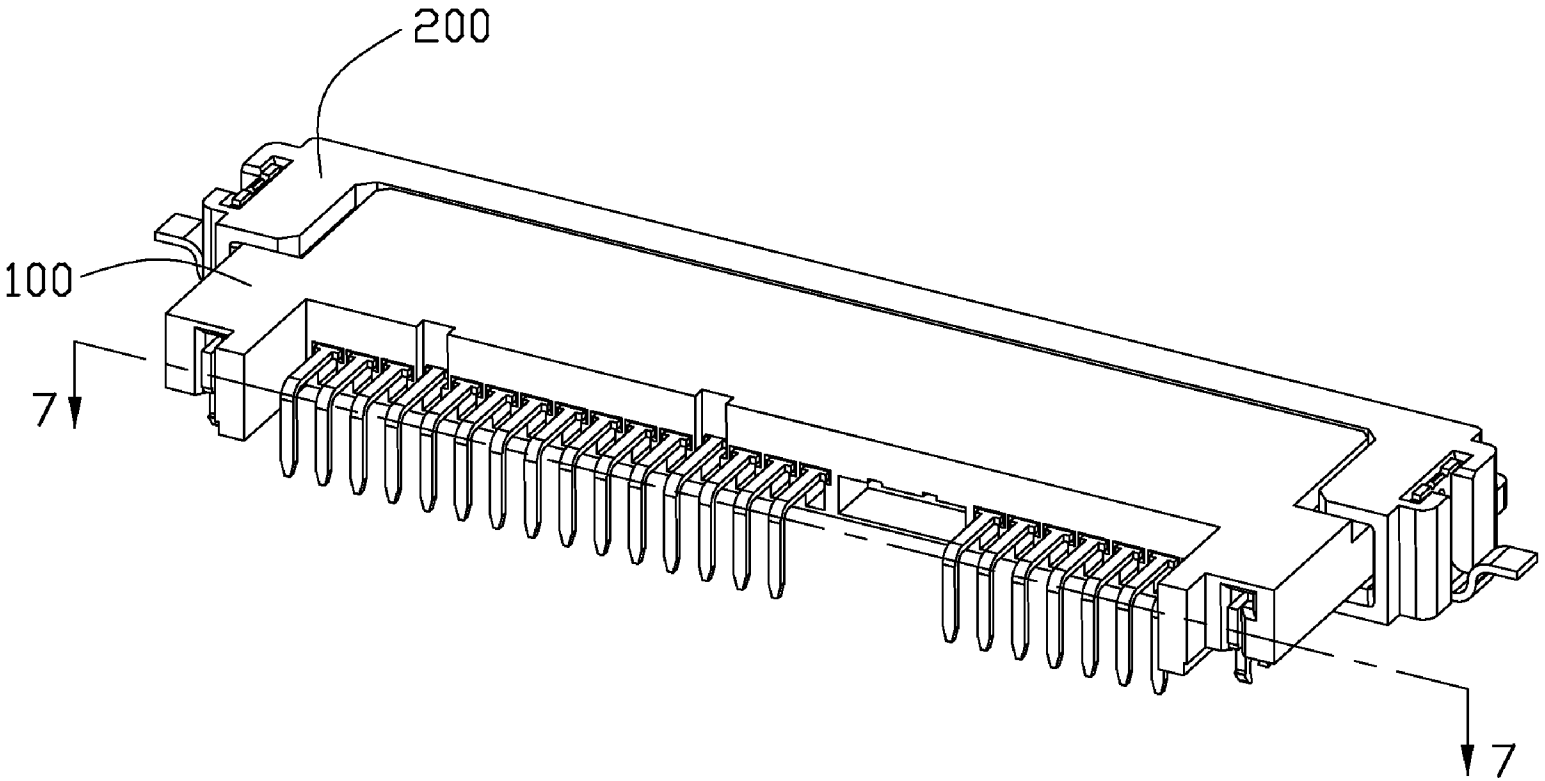
FIG. 5 is a perspective view of an engaged electrical connector assembly of the preferred embodiment which includes the connector of FIG. 1 and a mating connector.
Figure 6:
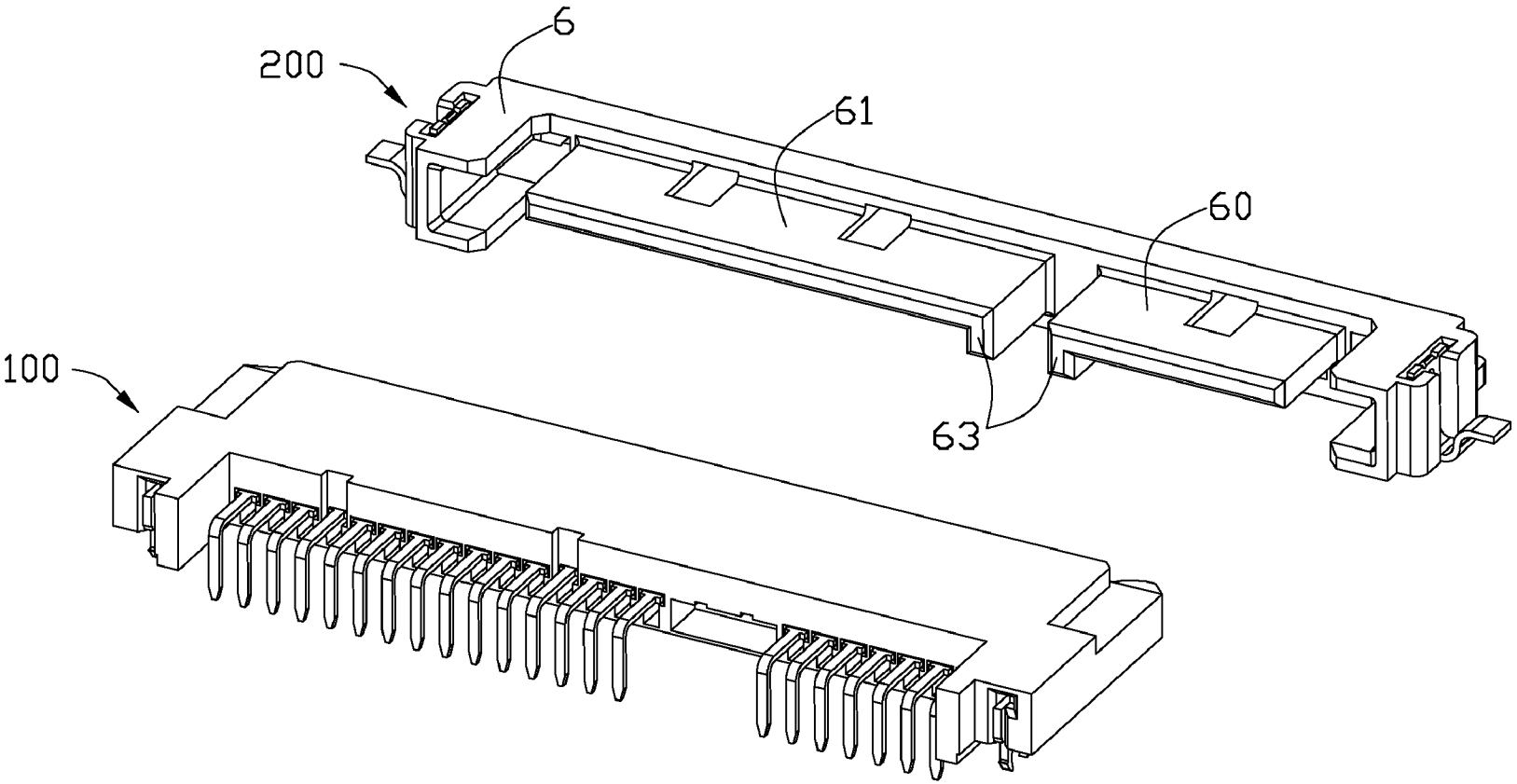
FIG. 6 is a perspective, view of the electrical disconnected connector assembly of FIG. 5.
Figure 7:
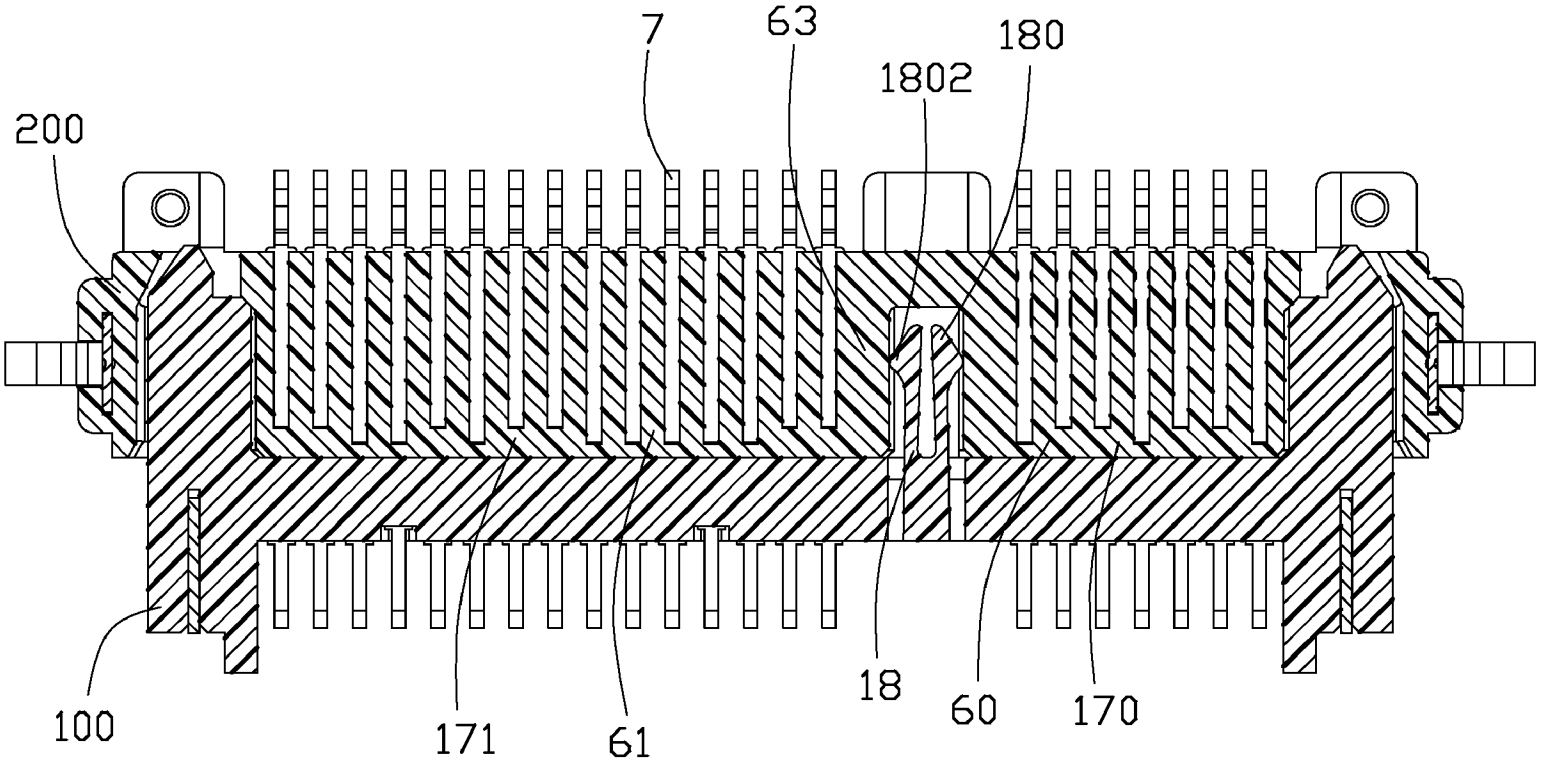
FIG. 7 is a cross sectional view of the electrical connector assembly, taken along line 7-7 of FIG. 5.

Referring to FIGS. 1 to 7, an electrical connector assembly includes a first electrical connector 100 and a second electrical connector 200 adapted for mating with the first connector 100.

The first electrical connector 100 comprises a first insulative housing 1, a plurality of first terminals 2 retained in the first insulative housing 1 and a pair of board locks 3 secured in the housing 1 for mounting on a printed circuit board.

The first insulative housing 1 defines a mating face 11, a rear wall 12 opposite to the mating face 11 and opposite upper and bottom walls 13, 14. A first slot 170 and a second slot 171 with different lengths are rearward formed from the mating face 11 of said first housing 1 by said walls. The two slots 170, 171 have two recesses 141 at their adjacent ends. The first housing 1 further comprises a latch 18 integrally extending from the rear wall 12 forwardly and located between the first slot 170 and the second slot 171. The latch 18 has two opposite arms 180 separated by a groove 183, thereby providing resiliency. The two arms 180 have two opposite bevel projections 1802 extending into corresponding slots 170, 171 respectively. Two stopping portions 181 extending from corresponding walls 13, 14 toward the latch 18 are located between the two slots 170, 171 so as to limit the ultra movement of the latch 18 toward upper and lower walls 13, 14. A pair of holes 184 penetrates through the rear wall 12 of the first housing 1 and is located at two sides of the latch 18.

A plurality of first terminals 2 are secured in a number of passageways 140 of the first housing 1 respectively. Each terminal 2 defines a contact portion 21 exposed into the corresponding slot.

A second electrical connector 200 adapted for mating with said first connector 100 comprises a second insulative housing 6 and a plurality of terminals 7 retained in the second housing 6.

The second insulative housing 6 has a first tongue 60 and a second tongue 61 adapted to be inserted into said slots 170, 171 of the first housing 1. The two tongues 60, 61 are spaced from each other with a distance so as to receive said latch 18 and have two protrusions 63 at their adjacent ends. A plurality of second terminals 7 are secured in the second insulative housing 6, and each terminal 7 defines a contact section exposed on a mating face of the corresponding tongues 60, 61 for forming an electrical connection with said contact portion 21 of the first terminal 2.

When the two connectors mate with each other, the two arms 180 of said latch 18 are resiliently fitted between two protrusions 63 of the two tongues 60, 61 of the second housing 6. Therefore, the first connector 100 mates with the second connector 200 firmly.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. An electrical connector comprising:

an elongated insulative housing defining a mating face, a rear wall opposite to the mating face and two slots opening to the mating face and arranged side by side;

a plurality of terminals secured in the insulative housing, each terminal defining a contact portion exposing into the corresponding slot; wherein a latch integrally extends from the rear wall forwardly and is located between the two slots, the latch has two arms separated by a groove thereby providing resiliency, wherein the two arms have two opposite projections extending into corresponding slots, wherein said groove penetrates through the latch in a vertical direction of the insulative housing, wherein the insulative housing has opposite upper and bottom walls, two stopping portions extending from corresponding walls toward the latch are located between the two slots.

2. An electrical connector assembly comprising:

a first electrical connector comprising:

a first insulative housing defining a mating face, a rear wall opposite to the mating face and two slots with different lengths opening to the mating face, a latch integrally extending from the rear wall forwardly and located between the two slots;

a plurality of first terminals secured in the insulative housing respectively, each terminal defining a contact portion exposed to the corresponding slot; and a second electrical connector adapted for mating with said first connector comprising:

a second insulative housing having a pair of tongues adapted to be inserted into the slots of the first insulative housing, said tongues spaced from each other with a distance for receiving said latch;

a plurality of second terminals secured in the second housing;

wherein each latch has two arms separated by a groove to be resiliently fitted between said two tongues when the two connectors mate with each other, wherein the two arms have two opposite projections extending into corresponding slots, wherein the first housing has opposite upper and bottom walls, two stopping portions extending from corresponding walls toward the latch are located between the two slots.

3. A connector assembly comprising:

a first connector including:

a first insulative elongated housing with two spaced L-shaped mating cavities along a lengthwise direction;

a plurality of first contacts disposed in the housing with first contacting sections extending into the mating cavities; and a vertical partition wall located between said two spaced L-shaped mating cavities with two opposite faces facing toward the corresponding mating cavities, respectively; and a latch interrupting said vertical wall and having a pair of spring arms extending in a mating direction perpendicular to said lengthwise direction; wherein said spring arms define a pair of outward protrusions extending beyond the corresponding faces of the vertical partition wall in said lengthwise direction, and including a second connector comprising: a second insulative elongated housing defining two spaced L-shaped mating tongues along the lengthwise direction; a plurality of second contacts disposed in the second housing with second contacting sections exposed upon the mating tongues; wherein said pair of spring arms abut against vertical sections of said two L-shaped mating tongues, respectively.

* * * * *